US010847872B2

(12) United States Patent
Zhang et al.

(10) Patent No.: US 10,847,872 B2
(45) Date of Patent: Nov. 24, 2020

(54) WEARABLE DEVICE AND SMART WATCH

(71) Applicant: Goertek Inc., Shandong (CN)

(72) Inventors: Jianguo Zhang, Shandong (CN); Peijie Zhao, Shandong (CN); Lin Wang, Shandong (CN)

(73) Assignee: Goertek Inc., Shandong (CN)

( * ) Notice: Subject to any disclaimer, the term of this patent is extended or adjusted under 35 U.S.C. 154(b) by 14 days.

(21) Appl. No.: 15/743,581

(22) PCT Filed: Jul. 8, 2016

(86) PCT No.: PCT/CN2016/089376

§ 371 (c)(1),
(2) Date: Jan. 10, 2018

(87) PCT Pub. No.: WO2017/045466

PCT Pub. Date: Mar. 23, 2017

(65) Prior Publication Data

US 2018/0203421 A1 Jul. 19, 2018

(30) Foreign Application Priority Data

Sep. 16, 2015 (CN) ..... 2015 2 0716654 U
Sep. 16, 2015 (CN) ..... 2015 2 0716683 U

(51) Int. Cl.
*H01Q 1/27* (2006.01)
*H01Q 1/48* (2006.01)
(Continued)

(52) U.S. Cl.
CPC ..... *H01Q 1/273* (2013.01); *G04G 17/04* (2013.01); *G04G 21/04* (2013.01); *H01Q 1/48* (2013.01); *H01Q 9/30* (2013.01)

(58) Field of Classification Search
CPC ..... H01Q 1/244; H01Q 1/38; H01Q 1/242; H01Q 9/0421; H01Q 1/243; H01Q 1/42; H01Q 1/273; H01Q 1/48
(Continued)

(56) References Cited

U.S. PATENT DOCUMENTS

2013/0143420 A1* 6/2013 Light ..... H05K 3/4069 439/65
2013/0169504 A1* 7/2013 Jenwatanavet ..... H01Q 1/48 343/848
(Continued)

FOREIGN PATENT DOCUMENTS

CN 104427022 A 3/2015
CN 204596942 U 8/2015
(Continued)

OTHER PUBLICATIONS

International Searching Authority, International Search Report and Written Opinion for International Application No. PCT/CN2016/089376, dated Sep. 30, 2016, State Intellectual Property Office of the People's Republic of China, Beijing, China, 15 pages.
(Continued)

*Primary Examiner* — Robert Karacsony
(74) *Attorney, Agent, or Firm* — Alston & Bird LLP

(57) ABSTRACT

Disclosed are a wearable device and a smart watch. A printed circuit board (PCB) is provided in the wearable device. An antenna and an extension component for extending a reference ground of the antenna are assembled on the PCB board, the extension component being disposed outside the PCB board, and being connected to the PCB board by using a metal connector. A first connection end of the metal connector is connected to the PCB board, and a second connection end of the metal connector is connected to the extension component. The technical solutions provided in the present invention can overcome the shortcomings of low transmit power of an antenna and poor receiving sensitivity of the antenna in a current wearable device.

15 Claims, 7 Drawing Sheets

(51) Int. Cl.

| | |
|---|---|
| ***H01Q 9/30*** | (2006.01) |
| ***G04G 21/04*** | (2013.01) |
| ***G04G 17/04*** | (2006.01) |

(58) Field of Classification Search
USPC ..... 343/702, 872, 878
See application file for complete search history.

(56) References Cited

U.S. PATENT DOCUMENTS

| | | | | |
|---|---|---|---|---|
| 2015/0070226 | A1* | 3/2015 | Wong | H01Q 1/273 343/718 |
| 2015/0294781 | A1* | 10/2015 | Yosui | H01F 27/2804 343/850 |
| 2015/0378321 | A1* | 12/2015 | Fraser | G04G 21/04 368/10 |
| 2016/0218762 | A1 | 7/2016 | Tian et al. | |

FOREIGN PATENT DOCUMENTS

| | | | |
|---|---|---|---|
| CN | 104898769 | A | 9/2015 |
| CN | 204991953 | U | 1/2016 |
| WO | WO-2013/102225 | A1 | 7/2013 |
| WO | WO 2013/102225 | A1 | 7/2013 |

OTHER PUBLICATIONS

International Searching Authority, International Search Report (ISR) and Written Opinion for International Application No. PCT/CN2016/089376, dated Sep. 30, 2016, 9 pages, State Intellectual Property Office of the P.R.C., China.

* cited by examiner

WEARABLE DEVICE AND SMART WATCH

CROSS REFERENCE TO RELATED APPLICATIONS

This application is a national stage application, filed under 35 U.S.C. § 371, of International Application No. PCT/CN2016/089376, filed Jul. 8, 2016, which claims priority to Chinese Application No. 201520716683.0, filed Sep. 16, 2015, and to Chinese Application No. 201520716654.4, filed Sep. 16, 2015, the contents of all of which as are hereby incorporated by reference in their entirety.

BACKGROUND

Technical Field

The present invention relates to the technical field of wearable device manufacturing, and in particular, to a wearable device and a smart watch.

Description of Related Art

Currently, with the development of science and technology, the requirements on functions of wearable devices are also getting higher and higher. Besides, the demand for multiple communication bands of the wearable device becomes increasingly strong.

However, being constrained by the appearance of a wearable device, such as a wristwatch (bracelet), the complete machine cannot be made too large. For an antenna with a large electrical size (for example, GSM850 and GSM900 in 2G communication), the length (electrical length) of the ground reference may not satisfy the requirements of the antenna, and the antenna efficiency cannot be high; as a result, TRP and TIS of the whole machine is too low, causing undesirable consequences of a low emission power of the antenna, poor reception sensitivity of the antenna, excessive heat generation of the complete machine and so on.

To sum up, the existing wearable device has defects that reception sensitivity of antennas is poor and the emission power of antennas is low.

BRIEF SUMMARY

The present invention provides a wearable device and a smart watch, so as to solve problems of the existing wearable device that the emission power of antennas is low and the reception sensitivity of antennas is poor.

The present invention discloses a wearable device, comprising: a printed circuit board (PCB) provided therein, the PCB being assembled with an antenna; and an extension member for extending a ground reference of the antenna, wherein The extension member is provided outside the PCB, and is connected to the PCB via a metallic connector;

A first connecting end of the metallic connector is connected to the PCB, and a second connecting end of the metallic connector is connected to the extension member.

The present invention also discloses a smart watch, including: a dial, a wristband, a printed circuit board (PCB) provided within the dial, an antenna assembled on the PCB, and an extension member for extending a ground reference of the antenna, wherein, the wristband is made of a non-metallic material, the extension member is made, at least in part, of metal, is provided on the surface or in the interior of the wristband, and is connected to the PCB via a preset metallic connector.

The present invention also discloses a smart watch, including a dial, a wristband, a printed circuit board (PCB) provided within the dial, an antenna assembled on the PCB, and an extension member for extending a ground reference of the antenna, wherein, the wristband is made of a metallic material, at least part of the wristband is used as the extension member, and the metallic wristband is connected to the PCB via a preset metallic connector.

In view of the above, by providing the extension member outside the PCB and connecting the PCB and the extension member via the metallic connector, the wearable device and the smart watch according to the present invention can extend the ground reference of the antenna effectively, thereby improving the efficiency of the antenna and in turn improving the emission power and the reception sensitivity of the antenna, i.e., improving the total radiated power TRP and the total isotropic sensitivity TIS of the overall wearable device.

DETAILED DESCRIPTION OF VARIOUS EMBODIMENTS

In order to make the objects, technical solutions and advantages of the present invention clearer, a further detailed description of embodiments of the present invention is given by reference to accompanying drawings.

Figure 1:
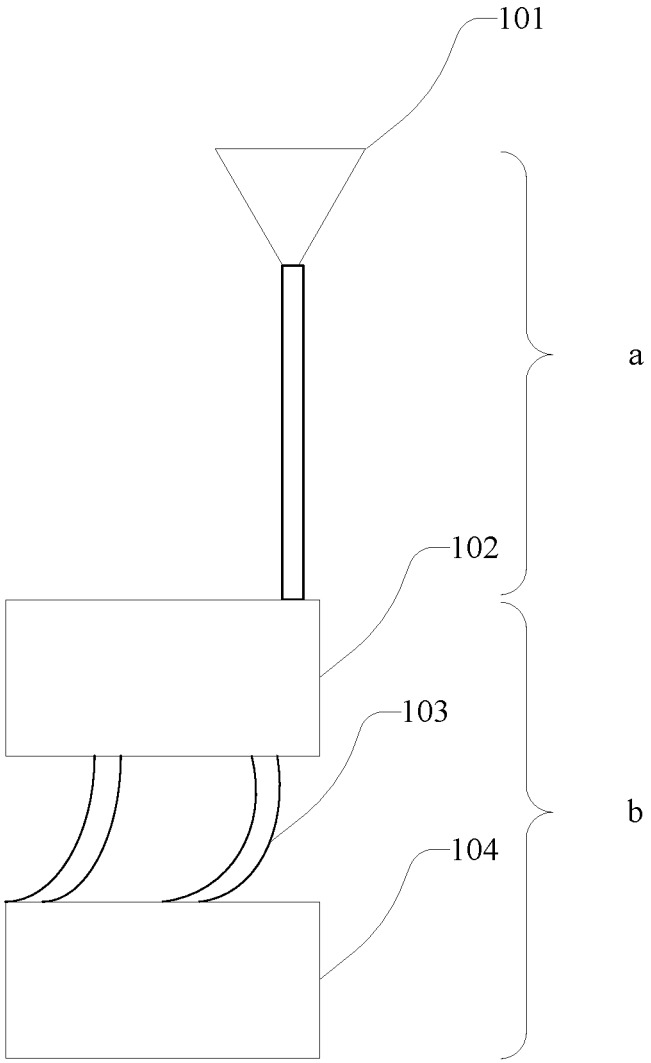
FIG. 1 is a schematic structural diagram of a wearable device according to the present invention.

FIG. 1 is a schematic structural diagram of a wearable device according to the present invention. The wearable device is provided with a PCB 102, and an extension member 104 for extending a ground reference of the antenna 101, wherein the PCB 102 is assembled with an antenna 101.

Referring to FIG. 1, the extension member 104 is provided outside the PCB 102, and is connected to the PCB 102 via a metallic connector 103;

Particularly, a first connecting end of the metallic connector 103 is connected to the PCB 102, and a second connecting end of the metallic connector 103 is connected to the extension member 104.

For a better connection between the extension member 104 and the PCB 102, and avoidance of the problem that two connecting ends of the metallic connector 103 fall off in the process of wearing the wearable device, or poor contact between the extension member 104 and the PCB, in an embodiment of the present invention, the metallic connector 103 has an elastic structure. This arrangement has the following advantage. Since the extension member 104 is provided outside the PCB 102, the extension member 104 may be bent due to an external force. The metallic connector 103 is configured to be an elastic structure, so that the extension member 104 can be subject to certain deformation under the action of the external force, which plays a buffering role, in turn guarantees that two connecting ends of the metallic connector 103 are firmly fixed on the extension member 104 and the PCB 102, and avoids the problem of poor contact due to falling off.

In order to better guarantee that the extension member can extend the ground reference of the antenna, a mirror antenna of the antenna of the ground reference is made closer to one fourth of the emission wavelength of the antenna after the ground reference of the antenna is extended; thus the power of the antenna can be improved dramatically. In turn, the total radiated power TRP and the total isotropic sensitivity TIS of the overall wearable device can be improved. In an embodiment of the present invention, a difference between a total length from an upper edge of the PCB 102 to a lower edge of the extension member 104 and one fourth of an emission wavelength of the antenna is less than a preset threshold.

With reference to FIG. 1, since the mirror antenna portion of the antenna 101 falls on the PCB 102, the antenna 101 and the mirror antenna thereof of the ground reference together can form two radiating arms of a dipole antenna, forming a complete dipole antenna. If the length of the mirror antenna of the ground reference is less than one fourth of the emission wavelength of the antenna, then another complete radiating arm cannot be formed in the ground reference, causing that the dipole antenna cannot achieve the optimum effect. Particularly, the length a of the antenna is equal to one fourth of the emission wavelength of the antenna.

Figure 2:
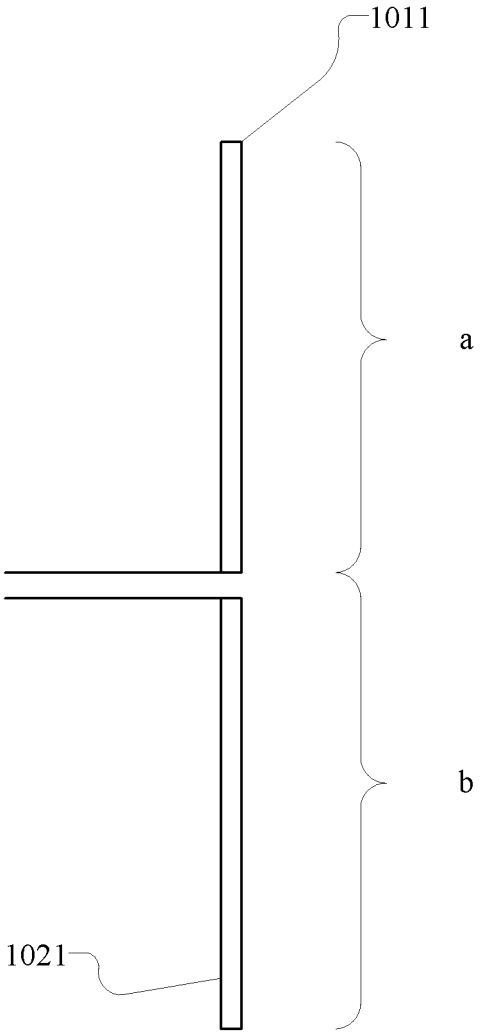
FIG. 2 is a schematic diagram of an equivalent antenna of the wearable device in FIG. 1.

FIG. 2 is a schematic diagram of an equivalent antenna of the wearable device in FIG. 1. With reference to FIG. 2, the length a of the antenna corresponds to the radiating arm 1011, the total length b from the upper edge of the PCB 102 to the lower edge of the extension member 104 corresponds to the radiating arm 1021, and the total length b from the upper edge of the PCB 102 to the lower edge of the extension member 104 is just a length of a mirror antenna of the ground reference of the antenna 101 on the PCB 102.

In the specific embodiments of the present invention, the longer the extension member 104 is, the better the effect of improving the power of the antenna is. However, due to limitations of the size of the PCB 102 in the wearable device and of the positions where the extension member 104 can be provided, in a specific embodiment, the total length b from the upper edge of the PCB 102 to the lower edge of the extension member 104 only can be made to be close to one fourth of the emission wavelength of the antenna as much as possible.

In a specific embodiment of the present invention, the total length from the upper edge of the PCB 102 to the lower edge of the extension member 104 is more than 40 mm.

In a specific embodiment of the present invention, a difference between the total length b from the upper edge of the PCB 102 to the lower edge of the extension member 104 and one fourth of an emission wavelength of the antenna is less than a preset threshold. Particularly, the preset threshold should be as small as possible, namely, the total length b from the upper edge of the PCB 102 to the lower edge of the extension member 104 should be close to one fourth of the emission wavelength of the antenna as much as possible, so that the effect of improving the power of the antenna will be better.

Figure 3:
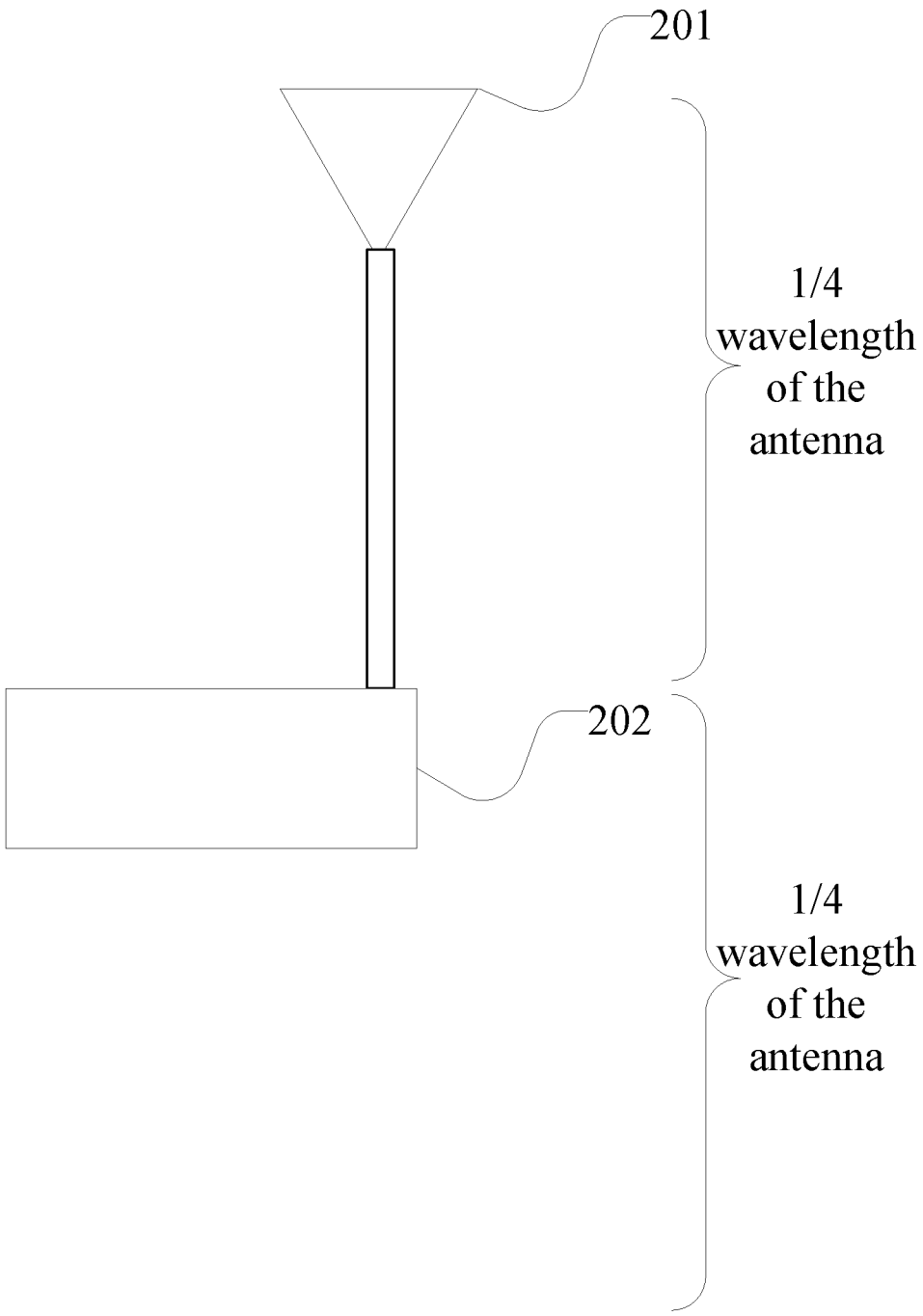
FIG. 3 is a schematic structural diagram of the wearable device in FIG. 1 where an extension member is not provided.
Figure 4:
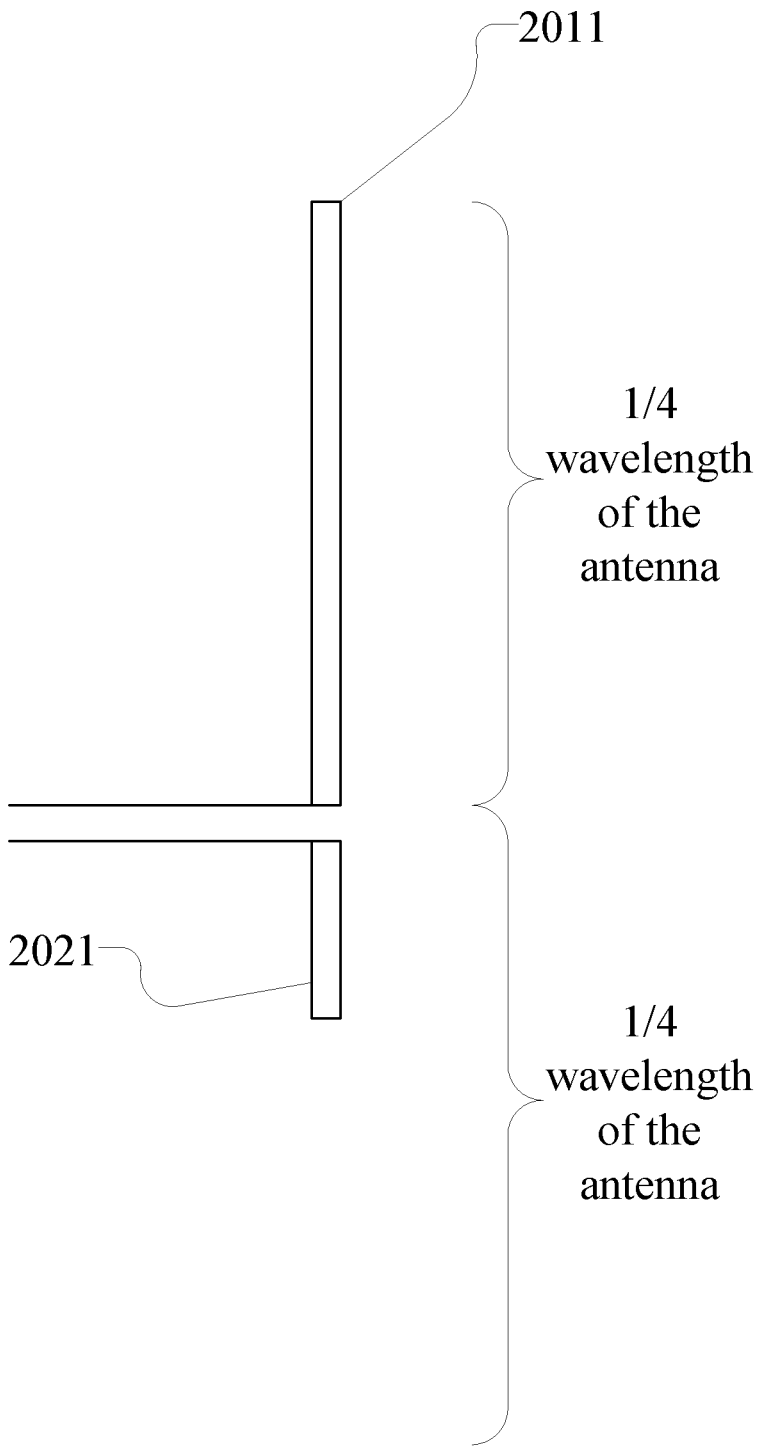
FIG. 4 is a schematic diagram of an equivalent antenna of the wearable device in FIG. 3.

FIG. 3 is a schematic structural diagram of the wearable device in FIG. 1 where an extension member is not provided; FIG. 4 is a schematic diagram of an equivalent antenna of the wearable device in FIG. 3. With reference to FIG. 3 and FIG. 4, the length of the antenna is one fourth of the emission wavelength thereof and corresponds to the radiating arm 2011; the length of the PCB 202 corresponds to the radiating arm 2021; the length of the PCB 202 is just a length of the mirror antenna of the ground reference of the antenna 201 on the PCB 202. Since the length of the PCB 202 is small, that is, the length of the ground reference is less than one fourth of the emission wavelength of the antenna, the antenna 201 cannot form another complete radiating arm in the ground reference, and the dipole antenna cannot achieve the optimum effect. Therefore, in the present invention, the ground reference of the antenna 101 can be extended by providing the extension member 104 and connecting the PCB 102 and the extension member 104 via the metallic connector 103, respectively, namely, the mirror antenna of the antenna 101 on the PCB 102 can be made longer, so that the antenna 101 can form another complete radiating arm in the ground reference.

Taking a 2G antenna with a frequency of 900 MHz as an example, the antenna is 83 mm long; a desirable length of the ground reference is one fourth of the wavelength at this frequency, i.e., about 83 mm; that is, the total length from the upper edge of the PCB 102 to the lower edge of the extension member 104 is not less than 83 mm. It can be seen that, in the present application, the total length of the PCB 102 and the extension member 104 can be made closer to the desirable ground reference by providing the extension member 104, so that the radiating arm length of the mirror antenna of the antenna 101 of the ground reference is at or close to one fourth of the wavelength, and the reception sensitivity of the antenna can be improved, that is, the TRP and the TIS of the overall wearable device can be improved.

Further, in order to reduce the electrical impedance and improve the conductive effect more efficiently, in a specific embodiment of the present invention, a contact area between the second connecting end and the extension member 104 is greater than a preset area threshold. That is to say, the second connecting end of the metallic connector 103 is in close contact with the extension member 104, and the contact area is greater than the preset area threshold, so that the purpose of effectively reducing the electrical impedance can be achieved.

Furthermore, in order to make the contact area between the metallic connector 103 and the extension member 104 as large as possible, in other embodiments of the present invention, the second connecting end consists of a plurality of metal pieces, and the total contact area between the plurality of metal pieces and the extension member 104 is larger than the preset area threshold. Namely, in this embodiment, the welding contact area between the metal piece and the extension member 104 can be increased by providing a plurality of metal pieces, thereby achieving the purposes of reducing the electrical impedance and improving the conductive effect.

In an embodiment of the present invention, the extension member 104 is: U-shaped, S-shaped, L-shaped, T-shaped or rectangular. With reference to FIG. 1, the extension member 104 is rectangular. In other embodiments of the present invention, the specific shape of the extension member 104 can be selected according to the design of the wearable device.

In the above specific embodiments of the present invention, the extension member 104 is a solid structure.

Figure 5:
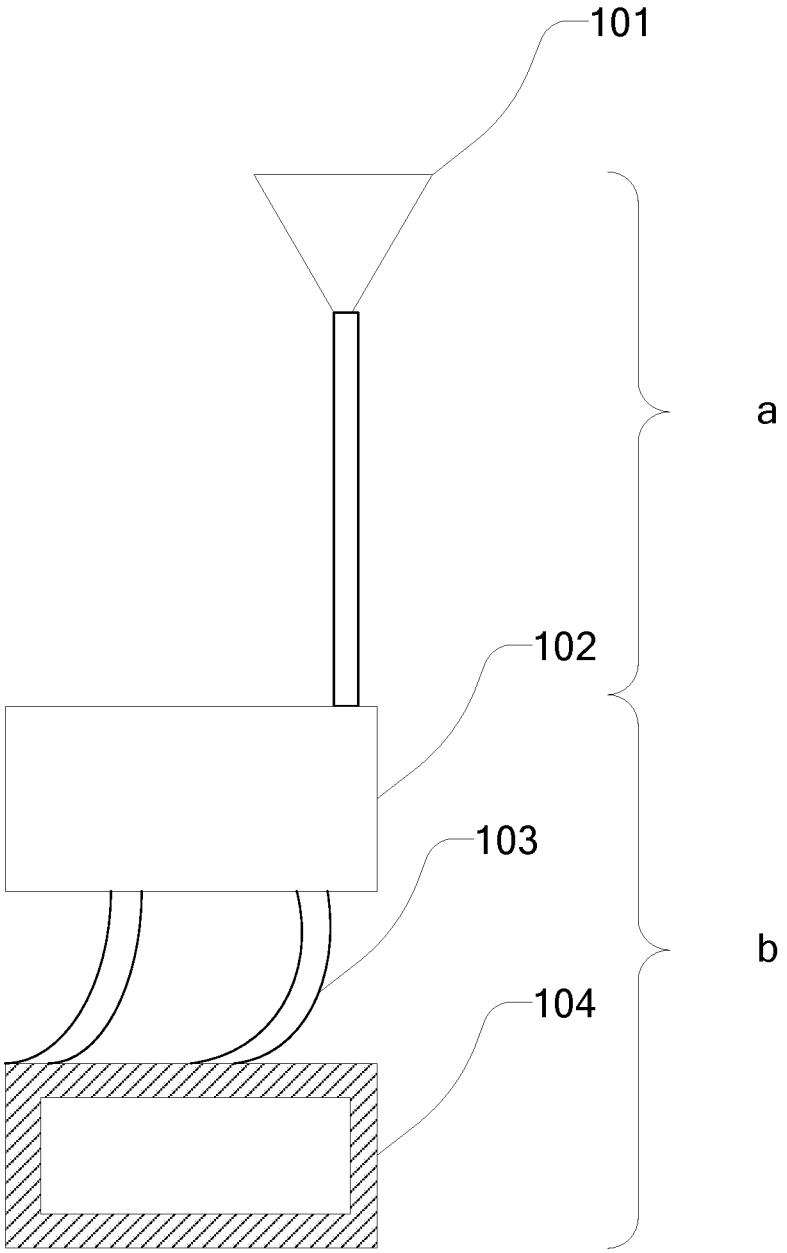
FIG. 5 is a schematic structural diagram of another wearable device according to the present invention.

Based on the principle of the skin effect, as the frequency increases, the high-frequency current tends to flow to the edge and the surface of a conductor. FIG. 5 is a schematic structural diagram of another wearable device according to the present invention; refer to FIG. 5, the extension member 104 also may be a hollow structure, namely, the extension member 104 is a hollow rectangular structure. Particularly, the shaded portion corresponds to a solid metallic structure while the white portion in the middle is a hollow portion.

In the specific embodiments of the present invention, since the materials of the conductors are different, the skin depth values at the same frequency are also different. Therefore, in the above embodiments of the present invention, an edge width of the extension member in a hollow structure is not less than the skin depth value of the extension member. Taking the copper medium as an example, namely, the extension member is a copper sheet; the copper medium has the skin depth value of $d=1000*66/((824+960)*106/2)^{1/2}\sim 2.2$ mm at room temperature under frequencies of 824 MHz to 960 MHz. Therefore, it is necessary for the edge width of the corresponding extension member in the hollow structure to be not less than 2.2 mm.

In the above embodiments of the present invention, the extension member 104 adopts a hollow structure; on the one hand, materials can be saved to reduce costs; on the other hand, the hollow structure of the extension member 104 can also match with the compact space or space with special holes in the interior of the wearable device to satisfy the requirements on compact space or space with special holes.

In an embodiment of the present invention, the metallic connector 103 is one or more springs.

In an embodiment of the present invention, the metallic connector 103 may also be a POGO PIN.

In an embodiment of the present invention, the metallic connector 103 also may be a part of the flexible printed circuit board.

The wearable device in the above embodiments of the present invention is a smart watch or a smart bracelet.

Figure 6:
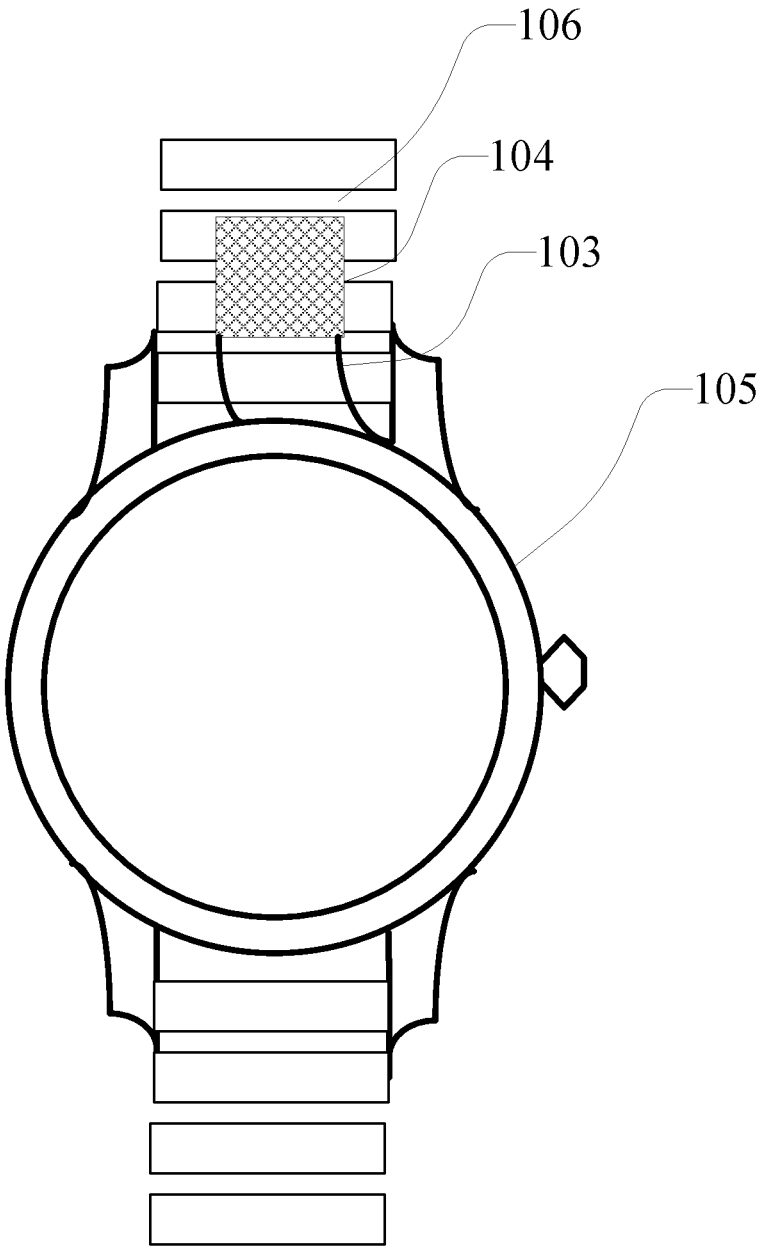
FIG. 6 is a schematic structural diagram of a smart watch according to the present invention.

The present invention also discloses a smart watch. FIG. 6 is a schematic structural diagram of a smart watch according to the present invention. As shown in FIG. 6, the smart watch includes a dial 105, a wristband 106, a printed circuit board (PCB, not shown) provided within the dial 105, an antenna (not shown) assembled on the PCB, and an extension member 104 for extending a ground reference of the antenna.

The wristband 106 is made of a non-metallic material, the extension member 104 is made, at least in part, of metal and is provided on the surface or in the interior of the wristband 106, and the extension member 104 is connected to the PCB via a preset metallic connector 103.

With reference to FIG. 1, for a better connection between the extension member 104 and the PCB 102 and avoidance of the problem that two connecting ends of the metallic connector 103 fall off in the process of wearing the wearable device, or poor contact between the extension member 104 and the PCB, in an embodiment of the present invention, the metallic connector 103 has an elastic structure. The advantages of such an arrangement have been illustrated in detail above when describing the wearable device, and will not be described herein redundantly.

In a specific embodiment of the present invention, the extension member 104 is a flexible printed circuit board (FPCB). The metallic connector 103 is one or more springs provided on the PCB 102; the FPCB is preset with one or more feed points, the one or more springs are arranged on corresponding one or more positions of the PCB 102; one end of the each spring away from the PCB 102 is connected to the feed point preset on the FPCB. That is, in the process of assembling, the FPCB is preset with one or two feed point positions, and the metallic connector 103 is arranged on a corresponding position of the corresponding PCB 102. The metallic connector 103 and feed points reserved for the FPCB are connected by welding, so as to achieve electrical connection of the FPCB and the PCB 102.

In a specific embodiment of the present invention, the extension member 104 may be a metal sheet. The metallic connector is one or more springs provided on the PCB 102; the metal sheet is preset with one or more feed points, the one or more springs are arranged on corresponding one or more positions of the PCB; one end of each spring away from the PCB is connected to the feed point preset on the metal sheet. That is, in the process of assembling, the metal sheet is preset with one or two feed point positions, and the metallic connector 103 is arranged on a corresponding position of the corresponding PCB 102. The metallic connector 103 and feed points reserved for the metal sheet are connected by welding, so as to achieve electrical connection of the metal sheet and the PCB 102. In other embodiments of the present invention, the metallic connector 103 is preset with an elastic metal leg, and thus the electrical connection of the metal sheet and the PCB can be achieved by connecting the preset elastic metal leg and the PCB 102.

In a specific embodiment of the present invention, the extension member 104 may be an electroplated member made through a laser direct structuring (LDS) process. Particularly, the extension member 104 is laser-engraved on the non-metallic wristband through an LDS process, that is, the electroplated member laser-engraved on the surface of the wristband of the smart watch is taken as the corresponding extension member 104. In the above embodiments of the present invention, one or two feed points are reserved during laser engraving, and corresponding metallic connectors 103 are assembled on the PCB 102 based on the number of the feed points reserved. The laser-engraved electroplated member and the PCB 102 are connected through the assembled metallic connector 103.

In the above embodiments of the present invention, in order to guarantee the electroplated member made through the LDS process and the non-metallic wristband to maintain aesthetic appearances, preferably, the corresponding extension member 104 is sprayed with corresponding coatings by means of spraying, so that the uniformity in appearance of the wristband can be kept without affecting the normal function of the extension member.

Figure 7:
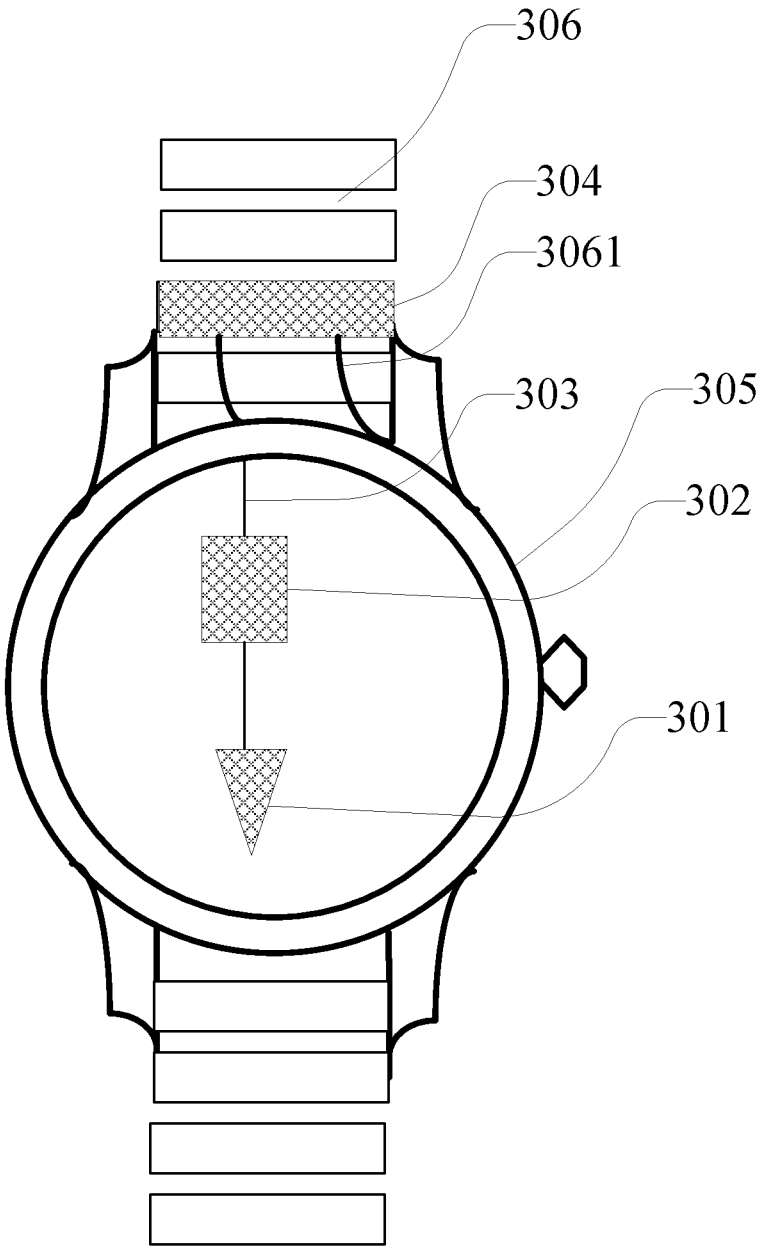
FIG. 7 is a schematic structural diagram of another smart watch according to the present invention.

The present invention also discloses a smart watch. FIG. 7 is a schematic structural diagram of a smart watch according to the present invention, and this smart watch differs from the one in the above embodiment in that the wristband is made of metallic materials. As shown in FIG. 7, the smart watch includes a dial 305, a wristband 306, a printed circuit board (PCB) 302 provided within the dial, an antenna 301 assembled on the PCB 302, and an extension member 304 for extending a ground reference of the antenna.

The wristband 306 is made of metallic materials, at least part of the wristband 306 is used as the extension member 304, and the metallic wristband 306 is connected to the PCB 302 via a preset metallic connector 303.

Similarly, for a better connection between the extension member 304 and the PCB 302, and avoidance of the problem that two connecting ends of the metallic connector 303 fall off in the process of wearing the smart watch, or poor contact between the extension member 304 and the PCB 302, the metallic connector 303 has an elastic structure.

In order to improve the performance of the extension member 304 and reduce the influence of the added additional parts on the overall appearance of the smart watch more efficiently, in this embodiment, the metallic wristband 306 is used as the extension member 304. Particularly, the metallic connector 303 is one or more springs; the metallic wristband 306 is provided with an elastic metal leg 3061, the metallic wristband 306 is connected to the metal dial 305 of the smart watch via the elastic metal leg 3061, and the metal dial 305 is connected to the PCB 302 via the one or more springs 303.

In any of the above embodiments of the smart watch, no matter if the smart watch has a metallic wristband or a non-metallic wristband, in order to better guarantee that the extension member can extend the ground reference of the antenna, an mirror antenna of the antenna of the ground reference is made closer to one fourth of the wavelength after the ground reference of the antenna is extended; thus the power of the antenna can be improved dramatically, and in turn, the TRP and the TIS of the overall smart watch can be improved. A difference between the total length from the upper edge of the PCB 302 to the lower edge of the extension member 304 and one fourth of an emission wavelength of the antenna is less than a preset threshold. The detailed description can be referred to the above descriptions of the wearable device, and will not be described herein redundantly.

In any of the above embodiments of the smart watch, in order to reduce the electrical impedance and improve the conductive effect more efficiently, the contact area between the connecting end on the metallic connector 303 for connecting the extension member 304 and the extension member 304 is greater than a preset area threshold. That is to say, the connecting end on the metallic connector 303 for connecting the extension member 304 is in close contact with the extension member 304, and the contact area is greater than the preset area threshold, so that the purpose of effectively reducing the electrical impedance can be achieved.

Alternatively, the connecting end on the metallic connector 303 for connecting the extension member 304 consists of a plurality of metal pieces, and the total contact area between the plurality of metal pieces and the extension member is larger than the preset area threshold. The detailed description can be referred to the above descriptions of the wearable device, and will not be described herein redundantly.

In any of the above embodiments of the smart watch, according to the design of the wearable device, the extension member 304 may be U-shaped, S-shaped, L-shaped, T-shaped or rectangular. The extension member may be a solid or hollow structure; particularly, the edge width of the extension member in a hollow structure is not less than the skin depth value of the extension member. The detailed description can be referred to the above descriptions of the wearable device, and will not be described herein redundantly.

In any of the above embodiments of the smart watch, the metallic connector is one or more springs or a POGO PIN.

In view of the above, by providing the extension member outside the PCB and connecting the PCB and the extension member via the metallic connector, the wearable device and the smart watch according to the present invention can extend the ground reference of the antenna effectively, thereby improving the efficiency of the antenna and in turn improving the emission power and the reception sensitivity of the antenna, i.e., improving the TRP and TIS of the overall wearable device. Further, in the present invention, the one or more springs are connected to the PCB and the extension member, respectively, so as to buffer the pressure generated when the extension member, the PCB and other components of the wearable device are mated, and to extend the service life of the wearable device; furthermore, the welding contact area between the metal piece and the extension member is increased, thereby reducing the electrical impedance and improving the conductive effect. Still further, the extension member adopts a hollow structure; on the one hand, materials can be saved to reduce costs; on the other hand, the hollow structure of the extension member also can match with the compact space or space with special holes in the interior of the wearable device, to satisfy the requirements on compact space or space with special holes.

What described above is only preferred embodiments of the present invention, and is not intended to limit the protection scope of the present invention. Any modification, equivalent replacement, and improvement made within the spirit and principle of the present invention fall within the protection scope of the present invention.

What is claimed is:

1. A wearable device, comprising:

a printed circuit board (PCB) provided therein, the PCB being assembled with an antenna;

an extension member for extending a ground reference of the antenna, the extension member being provided outside the PCB, the extension member being connected to the PCB via a metallic connector;

a first connecting end of the metallic connector connected to the PCB; and a second connecting end of the metallic connector connected to the extension member, wherein:

the extension member is a hollow rectangular structure having an outer edge and an inner edge;

a total length from an upper edge of the PCB to a lower edge of the extension member is equal to one fourth of an emission wavelength of the antenna; and a distance between the outer edge and the inner edge of the hollow rectangular structure is not less than a skin depth value of the extension member.

2. The wearable device according to claim 1, wherein the metallic connector has an elastic structure.

3. The wearable device according to claim 1, wherein a contact area between the second connecting end and the extension member is greater than a preset area threshold.

4. The wearable device according to claim 1, wherein a shape of the extension member is at least one of: U-shaped, S-shaped, L-shaped, T-shaped or rectangular.

5. The wearable device according to claim 2, wherein the metallic connector is one or more springs.

6. The wearable device according to claim 2, wherein the metallic connector is a POGO PIN.

7. The wearable device according to claim 1, wherein:

the second connecting end consists of a plurality of metal pieces, and a total contact area between the plurality of metal pieces and the extension member is larger than the preset area threshold.

8. The wearable device according to claim 1, wherein the extension member of a hollow structure is a copper sheet with an edge width of not less than 2.2 mm.

9. The wearable device according to claim 1, wherein:

the wearable device has a dial and a band portion, the band portion having two opposing ends attached to opposing sides of the dial; and the extension member is located on the band portion.

10. The wearable device according to claim 9, wherein the extension member is positioned on the band portion adjacent to but spaced apart from the dial.

11. The wearable device according to claim 9, wherein the antenna is located on the dial.

12. The wearable device according to claim 9, wherein the PCB is located on the dial.

13. The wearable device according to claim 1, wherein the inner edge of the hollow rectangular structure defines an enclosed central cavity of the extension member.

14. The wearable device according to claim 13, wherein the enclosed central cavity is rectangular in shape.

15. The wearable device according to claim 13, wherein the enclosed central cavity is absent any conductive material.

* * * * *